US006117628A

United States Patent [19]

Eichorst et al.

[11] Patent Number: 6,117,628

[45] **Date of Patent: *Sep. 12, 2000**

[54] IMAGING ELEMENT COMPRISING AN ELECTRICALLY-CONDUCTIVE BACKING LAYER CONTAINING METAL-CONTAINING PARTICLES

[75] Inventors: Dennis J. Eichorst, Fairport; Paul A. Christian, Pittsford, both of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/032,564

[22] Filed: Feb. 27, 1998

[51] Int. Cl.[7] ..... G03C 1/89

[52] U.S. Cl. ..... 430/530; 430/527; 430/531

[58] Field of Search ..... 430/527, 530, 430/531

[56] References Cited

U.S. PATENT DOCUMENTS

| | | | |
|---|---|---|---|
| 4,203,769 | 5/1980 | Guestaux | 430/527 |
| 4,275,103 | 6/1981 | Tsubusaki et al. | 430/67 |
| 4,394,441 | 7/1983 | Kawaguchi et al. | 430/527 |
| 4,416,963 | 11/1983 | Takimoto et al. | 430/69 |
| 4,418,141 | 11/1983 | Kawaguchi et al. | 430/527 |
| 4,431,764 | 2/1984 | Yoshizumi | 428/341 |
| 4,495,276 | 1/1985 | Takimoto et al. | 430/527 |
| 4,571,361 | 2/1986 | Kawaguchi et al. | 428/328 |
| 4,828,971 | 5/1989 | Przezdziecki | 430/527 |
| 4,999,276 | 3/1991 | Kuwabara et al. | 430/527 |
| 5,006,451 | 4/1991 | Anderson et al. | 430/527 |
| 5,026,622 | 6/1991 | Yamada et al. | 430/527 |
| 5,122,445 | 6/1992 | Ishigaki | 430/527 |
| 5,219,718 | 6/1993 | Hatakeyama et al. | 430/527 |
| 5,254,448 | 10/1993 | Yamada et al. | 430/527 |
| 5,284,714 | 2/1994 | Anderson et al. | 430/527 |
| 5,294,525 | 3/1994 | Yamauchi et al. | 430/530 |
| 5,310,640 | 5/1994 | Markin et al. | 430/527 |
| 5,340,676 | 8/1994 | Anderson et al. | 430/527 |
| 5,360,706 | 11/1994 | Anderson et al. | 430/529 |
| 5,366,855 | 11/1994 | Anderson et al. | 430/527 |
| 5,368,995 | 11/1994 | Christian et al. | 430/530 |
| 5,382,494 | 1/1995 | Kudo et al. | 430/527 |
| 5,427,835 | 6/1995 | Morrison et al. | 430/527 |
| 5,439,785 | 8/1995 | Boston et al. | 430/527 |
| 5,453,350 | 9/1995 | Kurachi et al. | 430/527 |
| 5,459,021 | 10/1995 | Ito et al. | 430/527 |
| 5,466,567 | 11/1995 | Anderson et al. | 430/527 |
| 5,484,694 | 1/1996 | Lelental et al. | 430/530 |
| 5,514,528 | 5/1996 | Chen et al. | 430/530 |
| 5,529,884 | 6/1996 | Tutt et al. | 430/201 |
| 5,529,891 | 6/1996 | Wang et al. | 430/537 |
| 5,547,821 | 8/1996 | Melpolder et al. | 430/527 |
| 5,565,311 | 10/1996 | Kawamoto | 430/527 |
| 5,679,505 | 10/1997 | Tingler et al. | 430/527 |
| 5,707,791 | 1/1998 | Ito et al. | 430/527 |
| 5,718,995 | 2/1998 | Eichorst et al. | 430/530 |

FOREIGN PATENT DOCUMENTS

| | | |
|---|---|---|
| 0 749 040 | 12/1996 | European Pat. Off. . |
| 4-055492 | 2/1992 | Japan . |

*Primary Examiner*—Richard L. Schilling
*Attorney, Agent, or Firm*—Carl F. Ruoff; Doreen M. Wells

[57] ABSTRACT

The present invention is an imaging element including, a support, at least one image-forming layer, and a transparent, electrically-conductive layer. The transparent, electrically-conductive layer includes conductive metal-containing fine particles dispersed in a polyurethane film-forming binder and a crosslinking agent. The polyurethane film-forming binder has a tensile elongation to break of at least 50% and a Young's modulus at a 2% elongation of a least 50,000 lb/in$^2$.

13 Claims, 2 Drawing Sheets

IMAGING ELEMENT COMPRISING AN ELECTRICALLY-CONDUCTIVE BACKING LAYER CONTAINING METAL-CONTAINING PARTICLES

CROSS REFERENCE TO RELATED APPLICATIONS

This application relates to commonly assigned copending application Ser. No. 09/032,049 filed simultaneously herewith and hereby incorporated by reference for all that it discloses.

FIELD OF THE INVENTION

This invention relates generally to imaging elements, and in particular, to photographic, thermographic, and photothermographic elements comprising a support, a silver halide imaging layer, and a transparent, electrically-conductive layer. More specifically, this invention relates to imaging elements having a transparent electrically-conductive outermost protective layer on the side of the support opposite to the imaging layer(s) which exhibits a high degree of scratch and abrasion resistance, excellent adhesion to the support, low dusting, and acceptable conveyance properties.

BACKGROUND OF THE INVENTION

Various problems associated with the generation and discharge of electrostatic charge during the manufacture and use of photographic film and paper products have been recognized for many years by the photographic industry. The accumulation of static charge on film or paper surfaces can produce irregular fog patterns in the sensitized emulsion layer(s). The presence of accumulated charge also can lead to difficulties in support conveyance as well as dust attraction to the support, which can result in repellency spots during emulsion coating, fog, desensitization, and other physical defects. The discharge of accumulated static charge during or after the application of sensitized emulsion layer (s) can produce irregular fog patterns or "static marks". The severity of static-related problems has been exacerbated greatly by increases in sensitivity of new emulsions, coating machine speeds, and post-coating drying efficiency. The generation of electrostatic charge during the film coating process results primarily from a tendency of high dielectric constant polymeric film base webs to undergo triboelectric charging during winding and unwinding operations, during conveyance through coating machines, and during finishing operations such as slitting and spooling. Static charge can also be generated during the use of the final photographic film product. In an automatic camera, winding roll film out of and back into the film cassette, especially in a low relative humidity environment, can produce static charging and result in marking. Similarly, high-speed automated film processing equipment can produce static charging that results in marking. Also, sheet films used in automated high-speed film cassette loaders (e.g., x-ray films, graphic arts films) are subject to static charging and marking.

One or more electrically-conductive antistatic layers can be incorporated into an imaging element in various ways to dissipate accumulated electrostatic charge, for example, as a subbing layer, an intermediate layer, and especially as an outermost layer either overlying the imaging layer or as a backing layer on the opposite side of the support from the imaging layer(s). A wide variety of conductive antistatic agents can be used in antistatic layers to produce a broad range of surface electrical conductivities. Many of the traditional antistatic layers used for imaging applications employ electrically-conductive materials which exhibit predominantly ionic conductivity, for example simple inorganic salts, alkali metal salts of surfactants, alkali metal ion-stabilized colloidal metal oxide sols, ionic conductive polymers or polymeric electrolytes containing alkali metal salts and the like. The electrical conductivities of such ionic conductors are typically strongly dependent on the temperature and relative humidity of the surrounding environment. At low relative humidities and temperatures, the diffusional mobilities of the charge carrying ions are greatly reduced and the bulk conductivity is substantially decreased. At high relative humidities an unprotected antistatic backing layer conataining such an ionic conducting material can absorb water, swell, and soften. Especially in the case of roll films, this can result in the adhesion (viz., ferrotyping) and even physical transfer of portions of a backing layer to a surface layer on the emulsion side of the film (viz., blocking).

Antistatic layers containing electronic conductors such as conjugated conductive polymers, conductive carbon particles, crystalline semiconductor particles, amorphous semiconductive fibrils, and continuous semiconductive thin films or networks can be used more effectively than ionic conductors to dissipate charge because their electrical conductivity is independent of relative humidity and only slightly influenced by ambient temperature. Of the various types of electronic conductors disclosed in prior art, electronically-conductive metal-containing particles, such as semiconductive metal oxides, are particularly effective when dispersed with suitable polymeric binders. Antistatic layers containing granular, nominally spherical, fine particles of crystalline semiconductive metal oxides are well known and have been described extensively. Binary metal oxides doped with appropriate donor heteroatoms or containing oxygen deficiencies have been disclosed in prior art to be useful in antistatic layers for photographic elements, for example: U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; 5,459,021; and others. Suitable claimed conductive binary metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include Sb-doped tin oxide, Al-doped zinc oxide, and Nb-doped titania. Additional preferred conductive ternary metal oxides disclosed in U.S. Pat. No. 5,368,995 include zinc antimonate and indium antimonate. Other suitable electrically-conductive metal-containing granular particles including metal borides, carbides, nitrides, and silicides have been disclosed in Japanese Kokai No. 04-055,492.

Antistatic backing or subbing layers containing colloidal "amorphous" vanadium pentoxide, especially silver-doped vanadium pentoxide, are described in U.S. Pat. Nos. 4,203,769 and 5,439,785. Colloidal vanadium pentoxide is composed of highly entangled microscopic fibrils or ribbons 0.005– 0.01 $\mu$m wide, about 0.001 $\mu$m thick, and 0.1–1 $\mu$m in length. However, colloidal vanadium pentoxide is soluble at the high pH typical of developer solutions for wet photographic film processing and must be protected by a nonpermeable, overlying barrier layer as taught in U.S. Pat. Nos. 5,006,451; 5,221,598; 5,284,714; and 5,366,855, for example. Alternatively, a film-forming sulfopolyester latex or a polyesterionomer binder can be combined with the colloidal vanadium oxide in the conductive layer to minimize degradation during processing as taught in U.S. Pat. Nos. 5,380,584; 5,427,835; 5,576,163; 5,360,706; and others.

When an electroconductive layer is the outermost layer on a support, it must be to protected against abrasion or scratching which may occur during handling of the photographic element in order to avoid degradation of its antistatic performance. Since the back side of an imaging element typically has more opportunity to come into direct contact with equipment surfaces and with mechanical parts during manufacture, winding and unwinding operations, use in a camera, processing, and printing or projecting the processed photographic element, it is particularly liable to abrasion damage or scratching. Scratches and abrasion marks not only degrade image quality during printing and projection processes but also in permanently damage processed photographic film. Numerous approaches to improving the resistance of the surface or outermost layers of photographic film to scratching and abrasion damage have been described in the prior art. As one of the more effective approaches, it is well known to provide at least one protective topcoat layer overlying the antistatic layer having physical properties such as increased hardness and reduced contact friction in order to enhance resistance to scratching and abrasion.

A photographic element having a conductive layer containing semiconductive tin oxide or indium oxide particles on the opposite side of the support from the silver halide sensitized emulsion layers with a polymer-containing intermediate backing layer overlying the conductive layer and an additional protective layer overlying the backing layer is disclosed in U.S. Pat. No. 5,026,622. The outermost protective layer includes gelatin, a matting agent, a fluorine-containing anionic surfactant, and dioctyl sulfosuccinate. Another conductive three-layer backing having an antistatic layer containing granular semiconductive metal oxide particles; an intermediate backing layer containing a latex of a water-insoluble polymer, matting agent, polystyrene-sulfonate sodium salt, and gelatin; and an outermost protective layer containing at least one hydrophobic polymer such as a polyester or polyurethane, fluorine-containing surfactant(s), matting agent(s), and an optional slipping aid is described in U.S. Pat. No. 5,219,718. Further, a three-layer backing having an antistatic layer including conductive metal oxide granular particles or a conductive polymer and a hydrophobic polymer latex, gelatin, and an optional hardener is overcoated with an intermediate backing layer containing gelatin, a hydrophobic polymer latex, a matting agent, and backing dyes that is simultaneously overcoated with a protective layer comprising a fluorine-containing surfactant, a matting agent, gelatin, and optionally, a polymer latex is taught in U.S. Pat. No. 5,254,448. Photographic elements including such multi-layer backings were disclosed to retain antistatic properties after processing, exhibit acceptable transport performance against Teflon coated surfaces, and have good "anti-flaw" properties.

The use of small (<15 nm) antimony-doped tin oxide particles having a high (>8 atom %) antimony dopant level and a small crystallite size (<100 Å) in abrasion resistant conductive backing layers is claimed in U.S. Pat. No. 5,484,694. A multi-element curl control layer on the backside of the support wherein the conductive layer typically is located closest to the support, with an overlying intermediate layer containing binder and antihalation dyes, and an outermost protective layer containing binder, matte, and surfactant is also claimed.

Simplified two-layer conductive backings are taught in U.S. Pat. Nos. 5,366,855; 5,382,494; 5,453,350; and 5,514,528. An antistatic layer containing colloidal silver-doped vanadium pentoxide and a vinylidene chloride-containing latex binder or a polyesterionomer dispersion coated on the opposite side of the support from the silver halide emulsion layer and subsequently overcoated with a protective layer including a coalesced layer containing both film-forming and non-film-forming colloidal polymeric particles, optional cross-linking agents, matting agents, and lubricating agents is disclosed in U.S. Pat. No. 5,366,855. Such a protective layer was also disclosed to function as an impermeable barrier to processing solutions, to resist blocking, to provide good scratch and abrasion resistance, and to exhibit excellent lubricity. However, the addition of hard polymeric particles, such as poly(methylmethacrylate), to a film-forming polymer can produce brittleness in a coated layer. A photographic element containing an aqueous-coated antistatic layer containing conductive fine particles such as metal oxide particles, a butyl acrylate-containing terpolymer latex, and optionally, a hardening agent and a surfactant that is overcoated with a solvent-coated, transparent magnetic recording layer containing preferably nitrocellulose or diacetyl cellulose as the binder and carnauba wax as a lubricant is taught in U.S. Pat. Nos. 5,382,494 and 5,453,350. Similarly, an antistatic layer containing conductive metal oxide granular particles in a hydrophilic binder applied as an aqueous or solvent dispersion and overcoated with a cellulose ester layer optionally containing ferromagnetic particles is described in U.S. Pat. No. 5,514,528. A separate lubricating overcoat layer can be optionally applied on top of the cellulose ester layer.

The inclusion of lubricant particles of a specified size, especially those having a fluorine-containing polymer, in a protective surface or backing layer containing a dispersing aid or stabilizer, a hydrophilic or resin-type binder and optionally, crosslinking agents, matting agents, antistatic agents, colloidal inorganic particles, and various other additives is described in U.S. Pat. No. 5,529,891. Photographic elements incorporating such protective layers were disclosed to exhibit improved surface scratch and abrasion resistance as evaluated on a Taber Abrader.

Another method to improve the slipperiness and scratch resistance of the back surface of a photographic element is described in U.S. Pat. No. 5,565,311. The incorporation of slipping agents containing compounds having both a long-chain aliphatic hydrocarbon moiety and a polyether moiety as a solution, emulsion or dispersion preferably in a backing protective layer containing a film-forming binder and an optional crosslinking agent overlying an antistatic layer is reported to provide improved slipperiness and scratch resistance and reduce the number of coated layers in the backing. The addition of a matting agent can improve scratch resistance as well as minimize blocking of the emulsion surface layer or emulsion-side primer layer by the backing layer. Further, the inclusion of an antistatic agent, such as conductive metal oxide particles, in a backing protective layer containing slipping and matting agents and optionally, nonionic, anionic, cationic, or betaine-type fluorine-containing surfactants is disclosed in U.S. Pat. No. 5,565,311.

An abrasion-resistant protective overcoat including a selected polyurethane binder, a lubricant, a matting agent, and an optional crosslinking agent overlying a conductive backing layer wherein the abrasion-resistant protective overcoat contains a crosslinked polyurethane binder, which can provide a nonpermeable chemical barrier for antistatic layers containing antistatic agents that are degraded by photographic processing such as vanadium pentoxide, as described in U.S. Pat. No. 5,679,505. Such a protective layer also was disclosed to be useful for overcoating antistatic layers containing electroconductive metal oxide granular particles which do not require protection from photographic processing solutions. It was further disclosed that because of the high volume loading of metal oxide particles required to obtain adequate antistatic properties, the physical properties of a single-layer conductive backing are substantially degraded and the use of an abrasion-resistant overcoat is needed to obtain suitable durability of the layers.

An electrically-conductive single layer backing having a combination of electrically-conductive fine particles, such as conductive metal oxide granular particles, and particular gelatin-coated water-insoluble polymer particles is disclosed in European Patent Application No. 749,040 to provide both a high degree of conductivity at low volumetric concentrations of conductive particles and a high degree of abrasion resistance. The use of a combination of insoluble polymer particles and a hydrophilic colloid with conductive metal oxide fine particles to prepare electrically-conductive layers that require lower volume fractions of conductive particles than conductive layers prepared using only a hydrophilic colloid as binder is disclosed in U.S. Pat. No. 5,340,676. A similar beneficial result is disclosed in U.S. Pat. No. 5,466,567 for electrically-conductive layers in which a combination of a hydrophilic colloid and pre-crosslinked gelatin particles is used as the binder for the electroconductive fine granular particles. However, the abrasion resistance of such gelatin-containing layers is unsuitable.

Electrically-conductive backing layers for use in thermally processable imaging elements are described in U.S. Pat. Nos. 5,310,640 and 5,547,821. As described in U.S. Pat. No. 4,828,971, backing layers useful for thermally processable imaging elements must provide adequate conveyance properties, resistance to deformation during thermal processing, satisfactory adhesion to the support, freedom from cracking and marking, reduced electrostatic charging effects, and exhibit no sensitometric effects. The use of electrically-conductive backings and protective overcoat layers for thermally processable imaging elements is described in U.S. Pat. No. 5,310,640. In one preferred embodiment, a protective layer containing polymethylmethacrylate as binder and a polymeric matting agent is positioned overlying a conductive layer containing silver-doped vanadium pentoxide dispersed in a polymeric binder. The use of a single-layer conductive backing having antimony-doped tin oxide granular particles, a matting agent, and a polymeric film-forming binder is taught in U.S. Pat. No. 5,547,821. Another preferred embodiment teaches the use of antimony-doped tin oxide granular particles in a conductive overcoat layer overlying the imaging layer. The reported Taber abrasion test results suggest that the relative level of abrasion resistance for the single-layer backings is inferior to that for the overcoated conductive backing layer described in U.S. Pat. No. 5,310,640. Also, surface scattering and haze is higher for single-layer conductive backings than for overcoated conductive backings. Further, from the surface resistivity and dusting data reported in U.S. Pat. No. 5,547,821, It can be concluded that it is particularly difficult to simultaneously obtain low dusting and high conductivity with single-layer conductive backings containing a polyurethane binder.

An electrically-conductive single-layer backing for the reverse side of a laser dye-ablative imaging element comprising electrically-conductive metal-containing particles, such as antimony-doped tin oxide particles, a polymeric binder, such as gelatin or a vinylidene chloride-based terpolymer latex, a matting agent, a coating aid, and an optional hardener is described in U.S. Pat. No. 5,529,884. Surface resistivity values ($\approx 10^9 \Omega$/sq) for the conductive backings were measured before and after the ablation process and exhibited virtually no change. No test data for abrasion or scratch resistance of the backing layers was reported.

As indicated hereinabove, the prior art for electrically-conductive backing layers and for abrasion and scratch resistant backing layers useful for imaging elements is extensive and a wide variety of multi-layer backings have been disclosed. However, there is still a critical need in the art for single-layer protective backings which provide multiple functions such as electrical conductivity combined with abrasion and scratch resistance. In addition to providing electrical conductivity and abrasion and scratch resistance, single-layer protective backings should resist the effects of humidity change, not exhibit adverse sensitometric or photographic effects, strongly adhere to the support, exhibit low dusting, exhibit no ferrotyping or blocking behavior, provide adequate support conveyance characteristics during manufacture and use, be unaffected by photographic processing solutions, and still be manufacturable at a reasonable cost. It is toward the objective of providing such improved electrically-conductive, abrasion and scratch resistant, low dusting, single-layer backings that more effectively meet the diverse needs of imaging elements, especially silver halide photographic films and thermally-processable imaging elements than those of the prior art that the present invention is directed.

SUMMARY OF THE INVENTION

The present invention is an imaging element including, a support, at least one image-forming layer, and a transparent, electrically-conductive abrasion resistaint protective layer. The transparent, electrically-conductive abrasion resistant protective layer includes conductive metal-containing fine particles dispersed in a polyurethane film-forming binder and a crosslinking agent. The polyurethane film-forming binder has a tensile elongation to break of at least 50% and a Young's modulus at a 2% elongation of a least 50,000 lb/in$^2$.

Figure 1:
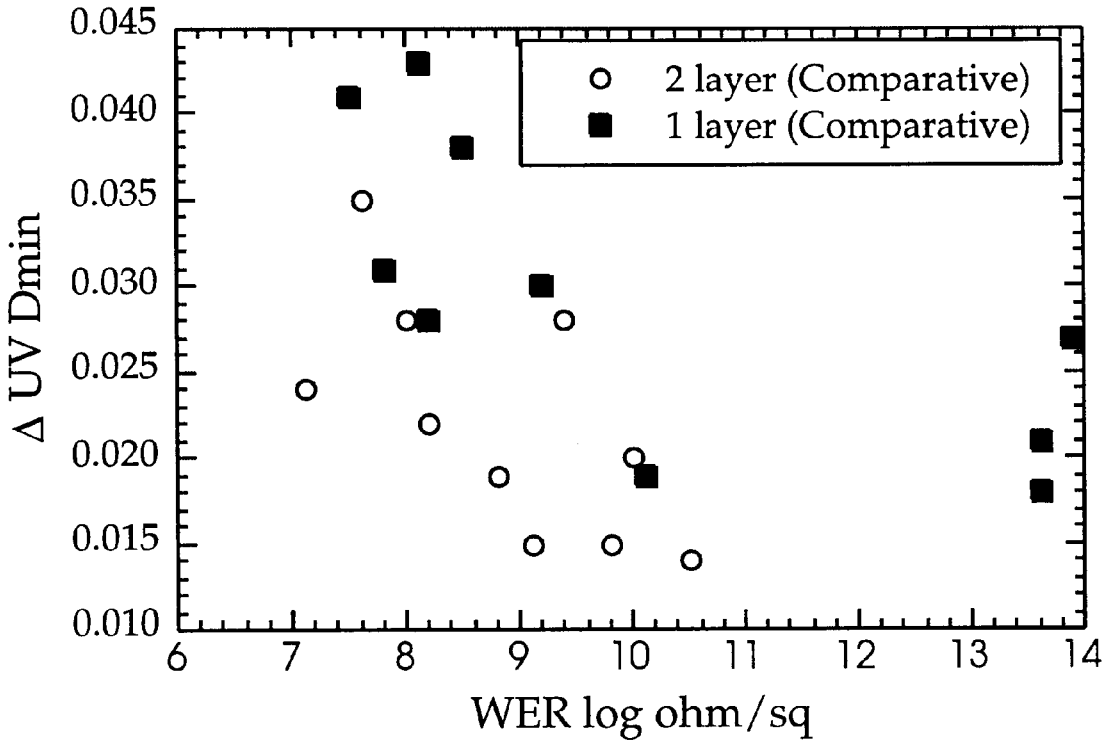
FIG. 1 shows the ultraviolet density versus internal resistivity for various backing layers.

For a better understanding of the present invention, together with other objects, advantages and capabilities thereof, reference is made tot the following detailed description and claims.

DETAILED DESCRIPTION OF THE INVENTION

The present invention provides an imaging element for use in an image-forming process comprising a support, at least one light- or heat-sensitive imaging layer, and at least one transparent electrically-conductive abrasion resistant protective layer, wherein the electrically-conductive protective layer is comprised of: (1) a specific class of electronically-conductive, crystalline, metal-containing particles; (2) a polyurethane film-forming binder having a tensile elongation to breaking of at least 50% and a Young's modulus measured at 2% elongation of at least 50,000 lb/in$^2$; and (3) a crosslinking agent. The protective layer may optionally contain a lubricating agent, a matting agent, and other addenda. In the case of photographic imaging elements, the electrically-conductive protective layer of this invention is located preferably on the side of the support opposite the sensitized emulsion layer(s) as a single-layer backing and may overlie an optional subbing layer. In the case of thermally-processable imaging elements, the transparent electrically-conductive layer can be a protective overcoat layer overlying an imaging layer, an abrasion resistant backing layer or an intermediate layer overlying a pelloid in a multi-element curl control layer. These conductive protective layers function both to dissipate electrostatic charge resulting from triboelectric charging of the imaging element and to protect the imaging element from damage due to abrasion and scratching which may take place during manufacturing, use or processing of the imaging element. The electrical conductivity of the conductive protective layer of this invention is nominally independent of relative humidity. Further, electrical conductivity is not degraded by exposure to aqueous solutions exhibiting a wide range of pH values (e.g., $2 \leqq pH \leqq 13$) as are commonly used in photographic processing.

The conductive protective layers of this invention can be incorporated in many different types of imaging elements including, for example, photographic, thermographic, electrothermographic, photothermographic, dielectric recording, dye migration, laser dye-ablation, thermal dye transfer, electrostatographic, and electrophotographic imaging elements. Detailed descriptions of the composition and function of this wide variety of different imaging elements are provided in U.S. Pat. No. 5,368,995.

Photographic elements that can be provided with an electrically-conductive protective single-layer backing in accordance with this invention can differ widely in structure and composition. For example, they can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche films, especially CRT-exposed autoreversal and computer output microfiche films. They can be black-and-white elements, color elements adapted for use in a negative-positive process or color elements adapted for use in a reversal process.

Conductive proctective backing layers in accordance with this invention can be applied to a variety of supports. Such supports can be either transparent or opaque (reflective). Transparent support materials used in the practice of this invention may be comprised of any of a wide variety of synthetic high molecular weight polymeric films such as cellulose esters including cellulose diacetate, cellulose triacetate, cellulose acetate butyrate, cellulose proprionate; cellulose nitrate; polyesters such as poly(ethylene terephthalate), poly(ethylene naphthalate), polycarbonate; poly(vinyl acetal); polyolefins such as polyethylene, polypropylene; polystyrene; polyacrylates; and others; and blends or laminates of the above polymers. Transparent film supports can be either colorless or colored by the addition of a dye or pigment. Suitable opaque or reflective supports comprise paper, polymer-coated paper, including polyethylene-, polypropylene-, and ethylene-butylene copolymer-coated or laminated paper, synthetic papers, and pigment-containing polyesters and the like. Of these support materials, films of cellulose triacetate, poly(ethylene terephthalate), and poly(ethylene naphthalate) prepared from 2,6-naphthalene dicarboxylic acids or derivatives thereof are preferred. The thickness of the support is not particularly critical. Support thicknesses of 2 to 10 mils (50 $\mu$m to 254 $\mu$m) are suitable for photographic elements in accordance with this invention.

In order to promote adhesion between the conductive backing of this invention and the support, the support can be surface-treated by various processes including corona discharge, glow discharge, UV exposure, flame treatment, electron-beam treatment, as described in U.S. Pat. No. 5,718,995 or treatment with adhesion-promoting agents including dichloro- and trichloro-acetic acid, phenol derivatives such as resorcinol and p-chloro-m-cresol, solvent washing or overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like.

One significant advantage of the conductive protective backing of this invention derives from the use of a specific class of conductive, metal-containing particles in combination with a specific class of polyurethane binders and a crosslinking or hardening agent. The physical properties of polyurethanes in accordance with this invention ensure that the backing layer is hard and sufficiently tough to provide excellent abrasion and scratch resistance. Use of metal-containing conductive particles in accordance with this invention, results in improved optical transparency and improved conductivity at reduced volume percent loadings of conductive metal-containing particles. The use of a crosslinking agent ensures cohesion of the conductive layer and also improves abrasion and scratch resistance. The polyurethane binder and crosslinking agent in combination with a specified volume loading of conductive particles results in excellent adhesion of optional matte particles which in turn, result in lower levels of dusting.

One particularly preferred class of electronically-conductive metal-containing granular particles useful for the electrically-conductive backing of this invention are semiconductive metal oxide granular particles. Suitable semiconductive metal oxide particles are those which exhibit a specific (volume) resistivity of less than $1\times10^5$ ohm·cm, preferably less than $1\times10^3$ ohm·cm, and more preferably, less than $1\times10^2$ ohm·cm. Examples of suitable semiconductive metal oxides include: zinc oxide, titania, tin oxide, alumina, indium oxide, silica, magnesia, zirconia, barium oxide, molybdenum trioxide, tungsten trioxide, vanadium pentoxide, and zinc antimonate and indium antimonate. Such semiconductive metal oxides are typically doped with donor heteroatoms or exhibit an oxygen atom deficiency. The semiconductive metal oxide that has been most widely used in electrically-conductive layers for photographic imaging elements is antimony-doped tin oxide. Antimony-doped tin oxide particles in accordance with this invention have antimony dopant levels ranging from about 8–20 atom % antimony. Another group of semiconductive metal oxides suitable for use in the present invention includes conductive metal carbides, conductive metal nitrides, conductive metal silicides, and conductive metal borides. Another physical property used to characterize tin oxide granular particles suitable for this invention is the average x-ray crystallite size. The concept of x-ray crystallite size is described in detail in U.S. Pat. No. 5,484,694 and references cited therein. Transparent conductive layers containing semiconductive antimony-doped tin oxide granular particles exhibiting a crystallite size less than 10 nm are taught in U.S. Pat. No. 5,484,694 to be particularly useful for imaging elements. Similarly, photographic elements including antistatic layers containing conductive granular metal oxide particles with average x-ray crystallite sizes ranging from 1 to 20 nm, preferably from 1 to 5 nm, and more preferably from 1 to 3.5 nm are claimed in U.S. Pat. No. 5,459,021. Advantages to using metal oxide particles with small crystallite size are disclosed in U.S. Pat. Nos. 5,484,694 and 5,459,021 and include the ability to be milled to a very small size without degradation of electrical performance, the ability to produce a specified level of conductivity at lower weight coverages, as well as decreased optical density, brittleness, and cracking of conductive layers containing such particles.

Antimony-doped tin oxide particles suitable for use in conductive protective layers of this invention exhibit a very small primary particle size, typically, less than 10 nm. A small particle size minimizes light scattering which reduces optical transparency of the conductive coating. In addition to ensuring transparency of thin conductive layers, a small average particle size is needed to form the multiplicity of interconnected chains or network of conductive particles which provide multiple electrically conductive pathways. A variety of semiconductive, crystalline, antimony-doped tin oxide powders are commercially available from various manufacturers (e.g., Keeling & Walker Ltd., Ishihara Sangyo Kaisha Ltd., Dupont Performance Chemicals, Mitsubishi Metals, Nissan Chemical Industries Ltd., etc.). However, not all commercial Sb-doped tin oxide powders are sufficiently chemically homogeneous to permit the extent of size reduction required to ensure both optical transparency and the formation of multiple conductive pathways and still retain sufficient particle specific conductivity to form conductive thin coated layers. Other suitable semiconductive metal oxides include, for example, a tin-doped indium sesquioxide, aluminum-doped zinc oxide, niobium-doped titanium dioxide, an oxygen-deficient titanium suboxide, $TiO_x$, where $x<2$, a titanium oxynitride, $TiO_xN_y$, where $(x+y)\leqq 2$, zinc antimonate, and indium antimonate.

One specific example of a suitable Sb-doped tin oxide is the electroconductive tin oxide powder described in Japanese Kokai No. 04-079104 and available under the tradename "SN-100P" from Ishihara Sangyo Kaisha Ltd. as granular particles of single phase, crystalline tin oxide doped with about 5–10 weight percent antimony. The average specific (volume) resistivity of SN-100P antimony-doped tin oxide powder is about 1–10 ohm·cm when measured as a packed powder using a DC two-probe test cell similar to that described in U.S. Pat. No. 5,236,737. The average equivalent circular diameter of primary particles of SN-100P Sb-doped tin oxide powder as determined by image analysis of transmission electron micrographs is approximately 10 nm. An x-ray powder diffraction analysis of this Sb-doped tin oxide has confirmed that it is single phase and highly crystalline having an x-ray crystallite size of about 35–45 Å for the as-supplied dry powder.

The small primary particle size of metal-containing granular particles in accordance with this invention permits the use of lower volume fractions of conductive particles in the coated conductive layers to obtain suitable levels of surface electrical conductivity than is possible using larger particles of prior art. This effectively increases the volume fraction of the polymeric binder which improves various binder-related properties of the conductive protective backings of this invention such as adhesion to the support, cohesion of the backing, and retention of optional matte particles, which can result in lower dusting levels. The preferred volume percent of metal-containing particles is in the range of from about 9 to 30%. The amount of metal-containing particles in the backing layer is defined in terms of volume percent rather than weight percent because the densities of suitable conductive particles may vary widely. For the antimony-doped tin oxide particles described hereinabove, this corresponds to tin oxide to binder weight ratios of from about 2:3 to 3:1. The use of significantly less than about p volume percent conductive metal-containing granular particles in the conductive protective layer of this invention will not provide a useful level of surface electrical conductivity. Use of significantly more than 30 volume percent of conductive metal-containing particles defeats one of the objectives of this invention in that it results in increased dusting. Use of more than 70 volume percent of conductive metal-containing particles defeats several other objectives of this invention in that it results in reduced transparency and increased haze due to scattering losses, diminished adhesion between the backing layer and the support, and decreased cohesion of the backing layer itself. Use of more than 30 but less than 70 volume percent accomplishes several of the objectives of this invention including improved conductivity, good transparency, adhesion, and haze but results in increased dusting. Thus, the conductive backing layer of this invention includes conductive metal-containing particles in the amount of preferably 30 volume percent or less and more preferably, 25 volume percent or less. The optimum volume fraction of the conductive particles varies depending on particle size, binder type, and conductivity requirements of the particular imaging element.

The use of polyurethane in abrasion and scratch resistant protective layers overlying antistatic layers containing metal-containing granular conductive particles has been disclosed, for example, in U.S. Pat. Nos. 5,366,855, 5,547,821 and U.S. Pat. No. 5,679,505. Conductive single-layer abrasion and scratch resistant protective of the present invention are prepared from a coating solution containing a dispersion of metal-containing conductive particles with a film-forming polyurethane binder and a crosslinking agent. Such conductive protective layers are well-suited to photographic as well as thermally processable imaging elements and exhibit substantially improved antistatic, abrasion and scratch resistance, dusting, transparency, haze, and manufacturability properties compared with those of prior art cited above. Polyurethanes suitable for use in conductive protective layers in the present invention are characterized as having a tensile elongation to break of at least 50% and a Young's modulus measured at 2% elongation of at least 50,000 $lb/in^2$. These physical property requirements for the polyurethane binder ensure that the backing layer is hard and sufficiently tough to provide excellent abrasion and scratch resistance and yet maintain sufficient adhesion to the conductive metal-containing particles of this invention as well as to optional matte particles to minimize dusting during manufacturing operations and also to maintain excellent adhesion of the conductive protective layer of this invention to the support after processing. Aliphatic polyurethanes are preferred because of their excellent thermal and UV stability and freedom from yellowing. Suitable polyurethanes can be either aqueous dispersible or solvent soluble material. The preferred polyurethane binder in accordance with this invention is coated as an aqueous dispersion of colloidal polymeric particles.

The preparation of aqueous polyurethane dispersions is well-known in the art and involves chain extending an aqueous dispersion of a prepolymer containing terminal isocyanate groups by reaction with a diamine or a diol. The prepolymer can be prepared by reacting a polyester, polyether, polycarbonate or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically a carboxylic acid group. The anionic groups are then neutralized with a tertiary amine to form the aqueous prepolymer dispersion.

Crosslinking agents that react with functional groups present in polyurethane, for example, carboxyl groups, are necessary to improve the hardness and cohesion of the electrically-conductive protective layer. Suitable crosslinking agents for the preferred polyurethane binders include polyfunctional aziridines, carbodiimides, epoxies, and the like. A crosslinking agent can be used at about 0.5 to about 30 weight percent based on the total weight of the coated layer. A crosslinking agent concentration of about 2 to 10 weight percent is preferred.

In addition to the polyurethane binder, crosslinking agent, and conductive metal-containing particles, other components that are well known in the photographic art can also be present in the conductive protective layers of this invention. These additional components can include: matting agents, lubricating agents, surface active agents including fluorine-containing surfactants, dispersing and coating aids, viscosity modifiers, charge control agents, soluble and/or solid particle dyes, co-binders, antifoggants, biocides, and others. Although preferred to be included in the electrically-conductive protective layer, matting agents, lubricating agents, surface active agents including fluorine-containing surfactants, soluble and/or solid particle dyes, and others can optionally be contained in additional auxiliary layers either overlying or underlying the conductive layer of this invention. While the present invention provides an electrically-conductive protective layer which has excellent adhesion, abrasion resistance, durability and transparency and can optionally function as a transport control layer, it may be advantageous to apply additional auxiliary layers. In particular, auxiliary layers for transport control with the present invention are contemplated. Further, an optional overcoat layer can be applied to reduce the dusting level when volume loadings of metal containing particles are between 30 and 70 percent as required for specific applications.

A suitable lubricating agent can be optionally included in the conductive protective layer of this invention to produce a coefficient of friction that ensures good conveyance characteristics during both manufacturing processes and use of the finished imaging element by the customer. Various suitable conventional lubricating agents are known, including higher alcohol esters of fatty acids, higher fatty acid calcium salts, metal stearates, silicone compounds, paraffins, and the like as described, for example, in U.S. Pat. Nos. 2,588,756; 3,121,060; 3,295,979; 3,042,522; 3,489,567. For satisfactory conveyance characteristics, the lubricated surface should exhibit a coefficient of friction of from 0.10 to 0.40. However, a more preferred range is from 0.15 to 0.30. If the coefficient of friction of the backing layer is below 0.15, long, slit rolls of photographic film can become unstable in storage or during shipping. If the coefficient of friction is greater than about 0.30 during manufacturing or becomes greater than 0.30 after processing, which is common if water soluble lubricants are used, the conveyance characteristics are degraded. Aqueous dispersions of non-soluble lubricant particles are particularly preferred, especially lubricant particles of the type described in U.S. Pat. No. 5,529,891. Aqueous dispersed particles of carnauba wax, polyethylene oxide, microcrystalline waxes, paraffin wax, silicones, stearates, and amides can be incorporated directly into the aqueous coating formulations containing dispersions of polyurethane binder particles and conductive metal-containing particles used to coat the single-layer backings of this invention. This avoids the need to apply a separate lubricant overcoat that could potentially degrade the surface conductivity of the backing. Aqueous dispersions of carnauba wax and stearates are preferred as lubricating agents because of their effectiveness in controlling friction at low concentrations and their excellent compatibility with aqueous dispersed polyurethanes.

In addition to lubricants, matting agents commonly are incorporated in a backing layer to improve conveyance characteristics of photographic elements during manufacturing, use, processing, and printing or projecting. Further, matting agents reduce the potential for the backing layer to cause ferrotyping when brought in contact with the surface of emulsion layer(s) under the pressures typically present in roll films. The term "ferrotyping" is used herein to describe the condition in which a backing layer, when brought in direct contact with a surface layer on the emulsion-side of the photographic element under pressure, as in a tightly wound roll film, adheres to the emulsion-side layer sufficiently strongly such that some sticking is observed when the layers are separated. In severe cases of ferrotyping, damage to the surface of the emulsion-side layer can occur when the backing and emulsion-side layers are separated. Such damage can result in adverse sensitometric effects as well.

Single-layer conductive backings of the present invention can optionally include matting agents to minimize the possibility of ferrotyping or blocking. Suitable matting agents include inorganic particles such as silica, alumina-coated silica, calcium carbonate or other mineral oxides, glass spheres or polymeric particles such as ground polymers, high melting point waxes or matte beads. Polymeric matte beads are preferred because of their uniformity in shape and size distribution. Matte particles should have a mean diameter of from about 0.75 to 2.5 $\mu$m. Suitable dry coverages of matte particles range from about 1 to about 100 mg/m$^2$. However, the preferred coating weight of matte particles for use in the conductive backing of this invention is about 15 to about 65 mg/m$^2$.

It is well-known to include at least one of a wide variety of surfactants or coating aids in an outermost protective layer overlying the emulsion layer(s) or in an outermost backing layer as charge control agents to help dissipate accumulated electrostatic charge. A wide variety of ionic-type surfactants have been evaluated as charge control agents including anionic, cationic, and betaine-based surfactants of the type described, for example, in U.S. patent application Ser. Nos. 08/991,288 and 08/991,493 filed Dec. 16, 1997.

Aqueous dispersions of conductive metal-containing particles can be prepared in the presence of appropriate levels of optional dispersing aids, colloidal stabilizing agents or polymeric co-binders by any of various mechanical stirring, mixing, homogenization or blending processes well-known in the art of pigment dispersion and paint making. Alternatively, stable colloidal dispersions of suitable conductive metal-containing particles can be obtained commercially, for example, a stabilized dispersion of electroconductive antimony-doped tin oxide particles at nominally 30 weight percent solids is available under the tradename "SN-100D" from Ishihara Sangyo Kaisha Ltd. Suitable antimony-doped tin oxide colloidal dispersions exhibit a very small average agglomerate size. Dispersions of conductive metal-containing particles formulated with binders and additives can be coated onto a variety of supports described hereinabove by any of a variety of well-known coating methods. Handcoating techniques include using a coating rod, coating knife or a doctor blade. Machine coating methods include air doctor coating, reverse roll coating, gravure coating, curtain coating, bead coating, slide hopper coating, extrusion coating, spin coating and the like, as well as other coating methods known in the art.

The electrically-conductive protective layer of this invention can be applied to the support at any suitable coverage depending on the specific requirements of a particular type of imaging element. For example, for silver halide photographic films, dry coating weights of antimony-doped tin oxide in the conductive backing layer typically are in the range of from about 0.005 to about 1.5 g/m$^2$. Preferred coverages are in the range of about 0.01 to 0.75 g/m$^2$ and more preferred coverages are in the range of about 0.05 to 0.5 g/m$^2$.

The internal electrical resistivity (WER) of the single-layer electrically-conductive backing of this invention is either comparable to or superior to that of multi-layer conductive backings of prior art which have a protective overcoat overlying the antistatic layer. The electrically-conductive backing layer of this invention typically exhibits a surface resistivity of less than $1\times10^{10}$ ohms/square, preferably less than $1\times10^{9}$ ohms/square, and more preferably less than $1\times10^{8}$ ohms/square.

Single, conductive, abrasion and scratch-resistant protective layers of this invention can be incorporated in various types of imaging elements for specific imaging applications such as color negative films, color reversal films, black-and-white films, color and black-and-white papers, electrophotographic media, as well as thermally processable imaging elements including thermographic and photothermographic media, thermal dye transfer elements, laser dye ablation elements, laser toner fusion media, and the like. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially examples 16 and 21, are particularly suitable. Any of the known silver halide emulsion layers, such as those described in *Research Disclosure,* Vol. 176, Item 17643 (December, 1978) and *Research Disclosure,* Vol. 225, Item 22534 (January, 1983), and *Research Disclosure,* Item 36544 (September, 1994), and *Research Disclosure,* Item 37038 (February, 1995) are useful in preparing photographic elements in accordance with this invention.

Photographic elements having conductive backing layers of this invention can be either simple black-and-white or monochrome elements or multilayer and/or multicolor elements. Generally, the photographic element is prepared by coating the film support on the side opposite the conductive backing layer with one or more photosensitive image-forming layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

The present invention is further illustrated by the following examples of its practice. However, the scope of this invention is by no means restricted to these specific illustrative examples.

COMPARATIVE EXAMPLE 1

A multi-layer conductive backing comprising an antistatic layer and a separate polyurethane-containing protective overcoat was prepared in a manner similar to that taught in U.S. Pat. No. 5,679,505. An antistatic layer coating formulation containing colloidal silver-doped vanadium pentoxide gel dispersed in water with an aqueous polyesterionomer dispersion, and a wetting aid was prepared at 0.077% total solids. The coating formulation is given below:

| Component | Weight % (wet) |
|---|---|
| Polyesterionomer binder (AQ29D: Eastman Chemicals Co.) | 0.028% |
| Wetting aid (Triton X-100: Rohm & Haas) | 0.021% |
| Colloidal vanadium pentoxide | 0.028% |
| Water | balance |

The antistatic formulation applied to on a moving polyethylene terephthalate support using a coating hopper to give a nominal total dry coverage of 11 mg/m$^2$. The support was previously coated with a subbing layer consisting of a vinylidene chloride based terpolymer latex. The antistatic layer was subsequently overcoated with a polyurethane based protective topcoat containing lubricant and matte particles. The polyurethane topcoat formulation is given below:

| Component | mg/m$^2$ |
|---|---|
| Polyurethane binder (Witcobond W-232: Witco Chemical Co.) | 973.3 |
| Lubricant (Michemlube 160: Michelman Inc.) | 0.6 |
| Matte, poly(methylmethacrylate), 2 $\mu$m beads | 33.0 |
| Wetting aid (Triton X-100: Rohm & Haas) | 7.5 |
| Polyfunctional aziridine crosslinker (Neocryl CX-100, Polyvinyl Chemistry Industries) | 61.9 |

COMPARATIVE EXAMPLES 2–4

Multilayer backings were prepared in a similar manner to Comparative Example 1 except the antistatic layer included antimony-doped tin oxide particles at a tin oxide to binder weight ratio of 80/20 and coated to give a nominal total dry coverages ranging from approximately 430 to 1075 mg/m$^2$. The conductive antimony-doped tin oxide powder used in the present Comparative Examples is commercially available from Keeling and Walker, Ltd. under the trade name "CPM375". The tin oxide contains about 6 weight percent antimony and has a mean particle diameter of 15 nm after size reduction by attrition milling. Antistatic layers containing the conductive tin oxide particles were subsequently overcoated with a protective polyurethane topcoat as in Comparative Example 1.

COMPARATIVE EXAMPLES 5–10

Multilayer backings were prepared in a similar manner to Comparative Examples 2–4 except the antistatic layer included tin oxide dispersed in a terpolymer latex of acrylonitrile, vinylidene chloride and acrylic acid at tin oxide to binder weight ratios of 90/10 and 75/25 and coated to give nominal total dry coverages ranging from approximately 430 to 1075 mg/m$^2$. A description of these multilayer backings of the prior art and the single-layer backings described below are given in Table 1.

Backing samples having conductive layers, and protective topcoat layers, on various film supports were evaluated with regard to their electrical performance, optical transparency, adhesion performance, dusting and abrasion resistance, and their conveyance characteristics. Surface electrical resistivities (SER) of the conductive backings were measured at about 20° C. and nominally 50% relative humidity using a two-point DC probe by the method described in U.S. Pat. No. 2,801,191. Internal resistivities of multi-layer backings were measured by a wet electrode resistivity (WER) technique (See R. A. Elder, "Resistivity Measurements on Buried Conductive Layers", 1990 EOS/ESD Symposium Proceedings, pp. 251–254). Internal resistivities of single-layer backings were also measured to permit direct comparison with multilayer backings by minimizing differences arising from the two different measurement techniques. Internal resistivities also were measured for samples after processing by the standard C-41 photographic process.

Total optical and ultraviolet densities ($D_{min}$) were evaluated at 530 nm and 380 nm, respectively with a X-Rite Model 361T densitometer. Net or Delta UV $D_{min}$ and Delta ortho $D_{min}$ values were calculated by correcting the total optical and ultraviolet densities for the contributions of the uncoated support which then corresponds to the contribution of either the combined conductive and protective layers in the case of multilayer backings or of the single-layer backings.

Dry adhesion of the conductive backings was evaluated by scribing a small cross-hatched region into the coating with a razor blade. A piece of high-tack adhesive tape was placed over the scribed region and quickly removed from the coating. The relative amount of coating removed is a qualitative measure of the adhesion of the coating to the support. Wet adhesion was evaluated using a procedure which simulates wet processing of silver halide photographic elements. A one millimeter wide line was scribed into the backing or overcoat layer. The sample was then placed in KODAK Flexicolor developer solution at 38° C. for 3 minutes and 15 seconds. The sample was removed and then placed in a Flexicolor developer bath and a weighted rubber pad (approximately 3.5 cm diameter) with a 900 g applied weight was rubbed vigorously across the sample in the direction perpendicular to the scribe line. The amount of additional material removed is a relative measure of the wet adhesion of the coating. No removal was judged as "excellent", from 1 to 10 percent removal as "good", 10 to 20 percent as "fair", and greater than 20 percent as "poor".

The extent of dusting by multilayer and single-layer backings described hereinabove was evaluated using the procedure described in U.S. Pat. No. 5,547,821. A qualitative numerical scale ranging from 1–4 was used to rate the degree of dusting. For photographic imaging elements, particularly those which must be perforated, only very low levels of dusting can be tolerated. A numerical ranking of "1" was judged as "excellent", less than "2" as "good", from "2–3" as "poor", and from "3–4" as "very poor".

The multi-layer backings of prior art (Comparative Examples 1–10) have good internal resistivity and optical transparency, excellent dry adhesion and dusting behavior as demonstrated by the results for the above tests given in Table 2. Internal resistivities of the various backings were not changed appreciably by processing. However, it is desirable to further reduce the surface resistivity and improve wet adhesion characteristics for such conductive backings. Furthermore, it is highly desirable to provide these improvements in a single-layer backing prepared by a simplified manufacturing process.

COMPARATIVE EXAMPLES 11–20

Conductive backing layers were prepared according to the methods described in U.S. Pat. No. 5,547,821. The samples comprised a polyurethane binder (Witcobond W-232), antimony doped tin oxide particles (nonpreferred), matte particles and a coating aid (Olin 10G). Comparative Examples 11–16 were prepared in a manner identical to that used in Examples 1–6 of U.S. Pat. No. 5,547,821. Comparative Example 17 was similar to Example 19 of U.S. Pat. No. 5,547,821 except Comparative Example 17 was prepared as a backing layer rather than as an overcoat layer. Comparative Examples 18–20 were prepared in a similar manner but were coated at nominally total dry coverage 1075 mg/m$^2$. Samples prepared according to these methods differ from the present invention primarily in the omission of a crosslinking agent and in the use of a nonpreferred conductive metal-containing particle. Further, the volume percent loadings of conductive tin oxide used for Comparative Examples 17 and 20 lie outside of the preferred range for this invention. Descriptions of Comparative Examples 11–20 are given in Table 1. Note that the weight percent of the conductive agent for Comparative Examples 11–20 corresponds to weight percent of the total backing layer including additives rather than the weight percent of binder substituted by the conductive agent as for the other samples.

The single-layer conductive backings of Comparative Examples 11–20 demonstrate a significant improvement in surface resistivity and generally an improvement in wet adhesion relative to the multilayer backings of Comparative Examples 1–10. However, an accompanying increase in the net ultraviolet and optical densities is typically observed. Wet adhesion failure was observed for several backings as well. The increase in ultraviolet density for prior art single-layer backings relative to prior art multilayer backings as a function of internal resistivity is depicted in FIG. 1. For photographic imaging elements (e.g., roll films) which undergo multiple finishing operations such as slitting, perforating, and spooling, only low levels of dusting can be tolerated. The increased propensity of the prior art single layer backings of Comparative Examples 11–20 for dusting, relative to the multilayer backings is unacceptable for photographic imaging elements.

TABLE 1

| sample | backing structure | conductive agent | wt % agent* | dry coverage of conductive layer mg/m$^2$ | binder for protective layer |
|---|---|---|---|---|---|
| Comp Ex 1 | 2 layer | $V_2O_5$ | 50 | 11 | W-232 |
| Comp Ex 2 | 2 layer | CPM-375 | 80 | 430 | W-232 |

TABLE 1-continued

| sample | backing structure | conductive agent | wt % agent* | dry coverage of conductive layer mg/m$^2$ | binder for protective layer |
|---|---|---|---|---|---|
| Comp Ex 3 | 2 layer | CPM-375 | 80 | 645 | W-232 |
| Comp Ex 4 | 2 layer | CPM-375 | 80 | 1075 | W-232 |
| Comp Ex 5 | 2 layer | CPM-375 | 90 | 430 | W-232 |
| Comp Ex 6 | 2 layer | CPM-375 | 90 | 645 | W-232 |
| Comp Ex 7 | 2 layer | CPM-375 | 90 | 1075 | W-232 |
| Comp Ex 8 | 2 layer | CPM-375 | 75 | 430 | W-232 |
| Comp Ex 9 | 2 layer | CPM-375 | 75 | 645 | W-232 |
| Comp Ex 10 | 2 layer | CPM-375 | 75 | 1075 | W-232 |
| Comp Ex 11 | 1 layer | CPM-375 | 60 | 250 | W-232 |
| Comp Ex 12 | 1 layer | CPM-375 | 75 | 250 | W-232 |
| Comp Ex 13 | 1 layer | CPM-375 | 60 | 500 | W-232 |
| Comp Ex 14 | 1 layer | CPM-375 | 75 | 500 | W-232 |
| Comp Ex 15 | 1 layer | CPM-375 | 60 | 750 | W-232 |
| Comp Ex 16 | 1 layer | CPM-375 | 75 | 750 | W-232 |
| Comp Ex 17 | 1 layer | CPM-375 | 40 | 500 | W-232 |
| Comp Ex 18 | 1 layer | CPM-375 | 60 | 1075 | W-232 |
| Comp Ex 19 | 1 layer | CPM-375 | 75 | 1075 | W-232 |
| Comp Ex 20 | 1 layer | CPM-375 | 40 | 1075 | W-232 |
| Ex 1 | 1 layer | SN100D | 50 | 1075 | W-232 |
| Ex 2 | 1 layer | SN100D | 60 | 1075 | W-232 |
| Ex 3 | 1 layer | SN100D | 65 | 1075 | W-232 |
| Ex 4 | 1 layer | SN100D | 75 | 1075 | W-232 |
| Ex 5 | 1 layer | SN100D | 75 | 805 | W-232 |
| Ex 6 | 1 layer | SN100D | 60 | 805 | W-232 |
| Ex 7 | 1 layer | SN100D | 75 | 540 | W-232 |
| Ex 8 | 1 layer | SN100D | 60 | 540 | W-232 |
| Ex 9 | 1 layer | SN100D | 50 | 1690 | W-232 |
| Ex 10 | 1 layer | SN100D | 60 | 1615 | W-232 |
| Ex 11 | 1 layer | SN100D | 75 | 1615 | W-232 |
| Ex 12 | 1 layer | SN100D | 65 | 1075 | Sancure 898 |
| Ex 13 | 1 layer | SN100D | 60 | 1075 | W-232 |
| Ex 14 | 1 layer | SN100D | 60 | 1075 | W-232 |
| Comp Ex 21 | 1 layer | SN100D | 35 | 1075 | Sancure 898 |
| Comp Ex 22 | 1 layer | SN100D | 35 | 1075 | W-232 |
| Comp Ex 23 | 1 layer | SN100D | 40 | 1075 | W-232 |
| Comp Ex 24 | 1 layer | SN100D | 85 | 1075 | W-232 |
| Comp Ex 25 | 1 layer | SN100D | 90 | 1075 | W-232 |
| Comp Ex 26 | 1 layer | SN100D | 65 | 1075 | W-234 |
| Comp Ex 27 | 1 layer | CPM-375 | 65 | 1075 | W-232 |
| Comp Ex 28 | 1 layer | ECP-3010-XC | 65 | 1075 | W-232 |
| Comp Ex 29 | 1 layer | SN100D | 60 | 1010 | W-232 |

*Comparative Examples 11–20 weight percent of the total backing layer; all others, weight percent of conductive agent and binder

EXAMPLES 1–12

Single layer conductive protective backings were prepared using a tin oxide in accordance with the present invention dispersed in a polyurethane latex binder having a tensile elongation to break of at least 50% and a Young's modulus measured at a 2% elongation of at least 50,000 lb/in$^2$. Tensile elongation and Young's moduli were determined according to procedures set forth in ASTM D882 by the method described in U.S. Pat. No. 5,679,505 assigned to the same assignee as the present Application and are listed for select commercial polyurethanes in Table 3. The coating formulations were nearly identical to the protective topcoat formulation of Comparative Examples 1–10 except that the indicated weight percent (Table 1) of polyurethane binder was replaced with conductive tin oxide of the present invention. The nominal total dry weight coverage of Examples 1–4 was equivalent to the dry weight coverage of the protective topcoat (non-conductive) used for Comparative Examples 1–10. In addition to tin oxide, polyurethane binder, and crosslinking agent, the single layer backings contained optional matte, lubricant, and a wetting aid as for Comparative Examples 1–10. The volume fraction of tin oxide ranged from approximately 12 to 30 percent for the single layer conductive backings of Examples 1–12.

EXAMPLES 13 AND 14

Coating formulations were prepared as in Example 2 and coated onto a moving poly(ethylene naphthalate) support, rather than a poly(ethylene terephthalate) support, using a coating hopper to provide a nominal total dry coverage of 1075 mg/m$^2$. For Example 13, the poly(ethylene naphthalate) support was previously coated with a subbing or primer layer comprising a vinylidene chloride-based terpolymer latex. For Example 14, the poly(ethylene naphthalate) support was surface-treated with a corona discharge at a treatment level of 250 Watts immediately prior to applying the coating formulation.

Figure 2:
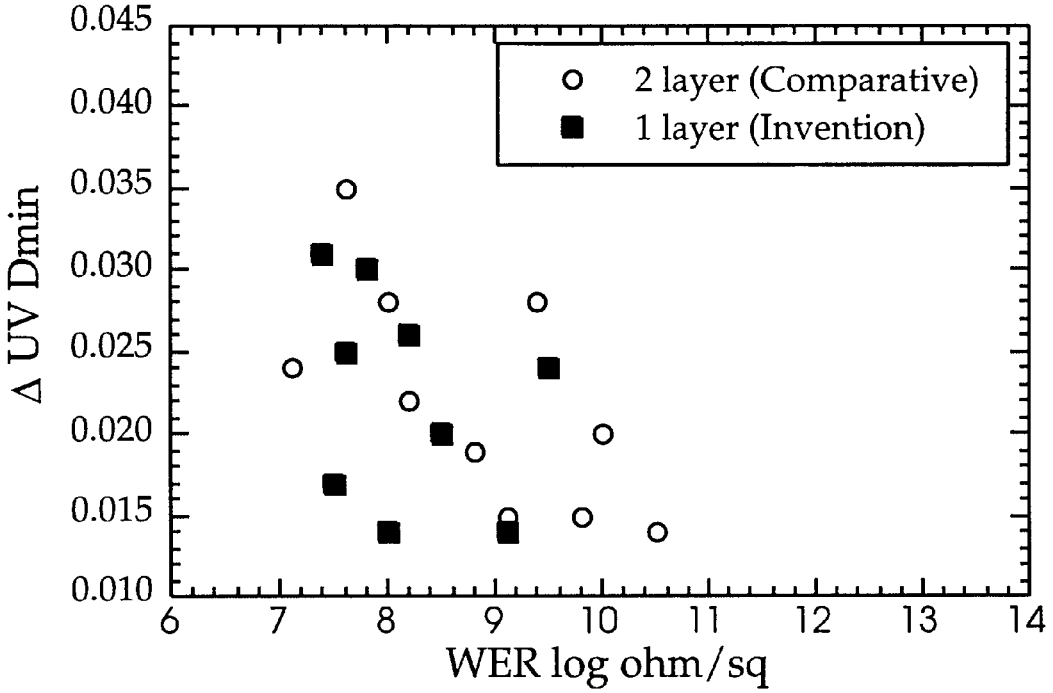
FIG. 2 shows the net ultraviolet density and internal resistivity for various backing layers.

The present examples demonstrate tha the single layer conductive protective backings of the present invention exhibit the desired improvements in surface resistivity and adhesion relative to multilayer backings of prior art without an increase in net ultraviolet or optical density. FIG. 2 compares the net ultraviolet density and internal resistivity for the single-layer backings of the present invention with multilayer backings of prior art. FIG. 2 clearly demonstrates the equivalent transparency for equivalent internal resistivity. However, the single layer backings of the present invention have the additional advantages of decreased surface resistivity, improved wet adhesion and a simplified manufacturing process. Surface resistivity is unaffected by photographic processing. Further, no increase in dusting behavior is observed as for prior art single-layer backings.

COMPARATIVE EXAMPLES 21–25

Single layer conductive backing layers were prepared in a manner similar to Examples 1–12, however the volume fraction of conductive tin oxide was outside of the preferred range. Backing layers of Comparative Examples 21–23 have tinoxide/binder weight ratios of 40/60 or less, corresponding to volume percentages less than 9 percent. Such low volume percentages of tin oxide produce insufficient conductivity for the layer to function as an antistatic layer. The backing layers of Comparative Examples 24 and 25 contained tin oxide to polyurethane weight ratios of 85/15 and 90/10 respectively, corresponding to a volume loading of over 30 percent. These samples exhibited excessive dusting and thus are unsuitable as protective layers for photographic imaging elements.

COMPARATIVE EXAMPLE 26

An electrically-conductive protective layer was prepared in a similar manner to Example 3, except the polyurethane binder was Witcobond W-234 which has a Young's modulus measured at a 2% elongation less than 50,000 lb/in$^2$ (See Table 3). The use of Witcobond W-234 as binder produced a conductive backing having unsuitable physical properties which did not satisfy the abrasion resistance and low dusting requirements.

COMPARATIVE EXAMPLES 27 AND 28

Electrically-conductive backing layers were prepared in a similar manner to Example 3, except that the conductive tin oxide particles used were non-preferred. Comparative Example 27 contained commercially available CPM-375 which exhibited a primary particle size after attrition milling of approximately 15 nm. The backing of Comparative Example 28 contained an electroconductive tin oxide powder commercially available from Dupont Chemicals under the tradename "ZELEC® ECP-3010-XC". The ZELEC® ECP-3010-XC tin oxide exhibited a primary particle size of less than 15 nm after attrition milling. In both instances, the use of a non-preferred tin oxide primary particle size produced significant levels of dusting, whereas backings containing the preferred tin oxide particles of the present invention exhibited low dusting behavior for comparable volume loading of conductive particles.

COMPARATIVE EXAMPLE 29

A single-layer conductive backing was prepared in a similar manner to Example 2 except that the crosslinking agent was omitted. Dusting levels were substantially higher for backings when the polyurethane binder was not crosslinked.

TABLE 2

| Sample | Raw SER log Ω/sq | Raw WER log Ω/sq | Processed WER log Ω/sq | dry adhesion | wet adhesion | Δ UV Dmin | Δ ortho Dmin | Dusting |
|---|---|---|---|---|---|---|---|---|
| C-Ex 1 | 12.9 | 7.5 | 7.5 | excellent | fair | 0.014 | 0.004 | excellent |
| C-Ex 2 | 11.6 | 10.5 | | excellent | good | 0.014 | 0.008 | good |
| C-Ex 3 | 11.1 | 10.0 | | excellent | good | 0.020 | 0.011 | — |
| C-Ex 4 | 11.3 | 9.4 | 9.0 | excellent | good | 0.028 | 0.015 | excellent |
| C-Ex 5 | 9.8 | 9.1 | | excellent | good | 0.015 | 0.008 | excellent |
| C-Ex 6 | 8.9 | 8.2 | | excellent | good | 0.022 | 0.011 | — |
| C-Ex 7 | 8.0 | 7.6 | | excellent | good | 0.035 | 0.017 | excellent |
| C-Ex 8 | 10.6 | 9.8 | | excellent | good | 0.015 | 0.006 | excellent |
| C-Ex 9 | 9.9 | 8.8 | | excellent | good | 0.019 | 0.010 | — |
| C-Ex 10 | 9.1 | 8.0 | 7.5 | excellent | excellent | 0.028 | 0.015 | excellent |
| C-Ex 11 | 13.6 | 12.2 | | excellent | excellent | 0.021 | 0.015 | very poor |
| C-Ex 12 | 10.1 | 9.7 | 10.3 | excellent | excellent | 0.019 | 0.016 | very poor |
| C-Ex 13 | 9.2 | 9.0 | 9.2 | excellent | excellent | 0.030 | 0.019 | poor |
| C-Ex 14 | 8.2 | 8.0 | 8.4 | excellent | excellent | 0.028 | 0.023 | very poor |
| C-Ex 15 | 8.5 | 8.2 | 8.5 | excellent | good | 0.038 | 0.024 | excellent |
| C-Ex 16 | 7.8 | 7.6 | 8.1 | excellent | excellent | 0.031 | 0.024 | very poor |
| C-Ex 17 | 13.6 | 12.4 | | excellent | very poor | 0.018 | 0.014 | poor |
| C-Ex 18 | 7.5 | 7.2 | 7.6 | excellent | excellent | 0.041 | 0.029 | — |
| C-Ex 19 | 8.1 | 7.9 | 8.2 | excellent | excellent | 0.043 | 0.027 | — |
| C-Ex 20 | 13.9 | 12.4 | | excellent | good | 0.027 | 0.017 | — |
| Ex 1 | 9.5 | 9.3 | 9.1 | excellent | excellent | 0.024 | 0.011 | excellent |
| Ex 2 | 8.2 | 8.0 | 8.2 | excellent | excellent | 0.026 | 0.016 | excellent |
| Ex 3 | 7.8 | 7.5 | 7.6 | excellent | excellent | 0.030 | 0.016 | excellent |
| Ex 4 | 7.6 | 7.2 | 7.7 | excellent | excellent | 0.025 | 0.012 | — |
| Ex 5 | 7.5 | 7.4 | 7.0 | excellent | excellent | 0.017 | 0.011 | — |
| Ex 6 | 8.5 | 8.3 | 8.5 | excellent | excellent | 0.020 | 0.011 | — |
| Ex 7 | 8 | 8.0 | | excellent | excellent | 0.014 | 0.007 | — |
| Ex 8 | 9.1 | 8.7 | | excellent | excellent | 0.014 | 0.008 | — |
| Ex 9 | 9.4 | 9.2 | 8.9 | excellent | — | 0.033 | 0.015 | — |
| Ex 10 | 7.9 | 7.8 | 7.8 | excellent | excellent | 0.035 | 0.019 | excellent |
| Ex 11 | 6.9 | 6.8 | 7.1 | excellent | excellent | 0.038 | 0.021 | — |
| Ex 12 | 7.4 | 7.2 | 7.4 | excellent | excellent | 0.031 | 0.015 | good |
| Ex 13 | 8.4 | 8.1 | 8.1 | excellent | excellent | 0.040 | 0.020 | excellent |
| Ex 14 | 8.2 | 8.6 | 8.3 | excellent | excellent | 0.013 | 0.009 | good |
| C-Ex 21 | 13.8 | 12.5 | | excellent | — | 0.024 | 0.011 | excellent |
| C-Ex 22 | 13.9 | >12.5 | 12.2 | excellent | fair | 0.020 | 0.009 | good |
| C-Ex 23 | 13.6 | >12.5 | >12.5 | excellent | — | 0.019 | 0.009 | excellent |

TABLE 2-continued

| Sample | Raw SER log Ω/sq | Raw WER log Ω/sq | Processed WER log Ω/sq | dry adhesion | wet adhesion | Δ UV Dmin | Δ ortho Dmin | Dusting |
|---|---|---|---|---|---|---|---|---|
| C-Ex 24 | 7.2 | 6.9 | 7.1 | excellent | excellent | 0.034 | 0.016 | very poor |
| C-Ex 25 | 7.1 | 6.9 | 7.1 | excellent | excellent | 0.035 | 0.016 | very poor |
| C-Ex 26 | 7.8 | 7.5 | 7. | excellent | excellent | 0.047 | 0.022 | very poor |
| C-Ex 27 | 9.3 | 9.2 | 9.1 | excellent | excellent | 0.034 | 0.023 | very poor |
| C-Ex 28 | 8.5 | 8.4 | | excellent | excellent | 0.031 | 0.023 | very poor |
| C-Ex 29 | 7.4 | 7.2 | | excellent | good | 0.025 | 0.015 | very poor |

TABLE 3

| Polyurethane | | Description | Modulus, lb/in$^2$ | Elongation to Break, % |
|---|---|---|---|---|
| W-232 | (Witco Corporation) | Invention | 103,000 | 150 |
| W-234 | (Witco Corporation) | Comparative | 31,000 | 350 |
| W-240 | (Witco Corporation) | Invention | 118,000 | 70 |
| W-242 | (Witco Corporation) | Invention | 73,000 | 50 |
| Sancure 898 | (B. F. Goodrich Company) | Invention | 115,000 | 210 |
| Sancure 815D | (B. F. Goodrich Company) | Invention | 180,000 | 220 |
| Sancure 12684 | (B. F. Goodrich Company) | Invention | 86,000 | 320 |
| Neorez 972 | (Zeneca Resins) | Comparative | 5,100 | 500 |

In addition to providing improved antistatic performance, adhesion, and transparency of the single-layer conductive backing of this invention it is a further objective of this invention to provide improved resistance of the conductive backing layer to scratching and abrasion. To assess the abrasion resistance of such a "multi-functional" backing layer, samples of support coated with the various backings were evaluated using a Taber Abrader and tested in accordance with ASTM method D1044. The test results are given in Table 4. In order to assess the relative conveyance properties of an imaging element comprising a single-layer conductive backing of the present invention, the friction was evaluated for Example 1 by a pin-on-disk method as disclosed in U.S. Pat. No. 5,234,889. The coefficient of friction was determined to be 0.22.

TABLE 4

| sample | backing structure | conductive agent | wt % agent | binder for protective layer | Taber Abrasion (% haze) |
|---|---|---|---|---|---|
| Comp Ex 1 | 2 layer | $V_2O_5$ | 50 | W-232 | 17.8 |
| Example 1 | 1 layer | SN100D | 50 | W-232 | 11.2 |
| Example 3 | 1 layer | SN100D | 65 | W-232 | 12.1 |
| Example 12 | 1 layer | SN100D | 65 | Sancure 898 | 10.5 |
| Comp Ex 21 | 1 layer | SN100D | 35 | Sancure 898 | 12.6 |
| Comp Ex 22 | 1 layer | SN100D | 35 | W-232 | 15.1 |
| Comp Ex 24 | 1 layer | SN100D | 85 | W-232 | 12.1 |
| Comp Ex 25 | 1 layer | SN100D | 90 | W-232 | 14.1 |
| Comp Ex 26 | 1 layer | SN100D | 65 | W-234 | 12.8 |
| Comp Ex 27 | 1 layer | CPM-375 | 65 | W-232 | 12.2 |

The above results clearly demonstrate that the use of conductive metal-containing particles in combination with a specified polyurethane binder and crosslinking agent at the specified range of volume percentages of conductive particles in accordance with the present invention provides highly conductive, transparent single-layer protective backings. The single layer protective backing of the present invention exhibit acceptable dusting levels, abrasion resistance or conveyance properties. Such single-layer backings result in improved surface conductivity which can provide improved antistatic protection relative to multilayer backings comprising an antistatic layer and an additional protective topcoat. Furthermore, the present invention allows simplification of the imaging element manufacturing process by reducing the number of required layers. Finally, conductive backings of the present invention are well-suited to the rigorous demands of both photographic and thermally processable imaging elements.

The invention has been described in detail with particular reference to certain preferred embodiments thereof, but it will be understood that variations and modifications can be effected within the spirit and scope of the invention.

What is claimed is:

1. A photographic film comprising a support, at least one silver halide emulsion layer, and a transparent, electrically-conductive, abrasion resistant protective layer conductive metal-containing particles dispersed in a polyurethane film-forming binder and a crosslinking agent, wherein said polyurethane film-forming binder has a tensile elongation to break of at least 50% and a Young's modulus at a 2% elongation of at least 50,000 lb/in$^2$ and wherein said metal-containing particles are 0.01 $\mu$m or less in diameter and have an x-ray crystallite size of about 50 Å or less.

2. The photographic film of claim 1, wherein said electrically-conductive metal-containing particles are selected from the group consisting of semiconductive metal oxides, heteroatom donor-doped metal oxides, metal oxides containing oxygen deficiencies, conductive metal carbides, conductive metal nitrides, conductive metal suicides, and conductive metal borides.

3. The photographic film of claim 1, wherein said electrically-conductive metal-containing particles are selected from the group consisting of tin oxide, indium sesquioxide, zinc oxide, titanium oxide, zinc antimonate, indium antimonate, molybdenum trioxide, tungsten trioxide, and vanadium pentoxide.

4. The photographic film of claim 1, wherein said electrically-conductive, metal-containing particles are selected from the group consisting of antimony-doped tin oxide, tin-doped indium sesquioxide, aluminum-doped zinc oxide, and niobium-doped titanium oxide.

5. The photographic film of claim 1, wherein said electrically-conductive, metal-containing particles exhibit a packed powder specific (volume) resistivity of $10^3$ ohm·cm or less.

6. The imaging element of claim 1, wherein the crosslinking agent comprises from 0.5 to about 30 weight percent based on the total weight of the coated layer.

7. The imaging element of claim 1, wherein said transparent, electrically-conductive, abrasion-resistant, protective layer comprises a dry weight coverage of crystalline single-phase, electrically-conductive, metal-containing particles ranging from 0.005 to 1.5 g/m$^{2.}$

8. The imaging element of claim 1, wherein the metal containing particles comprise a volume percent of the conductive protective layer of from 9 to 30.

9. The imaging element of claim 1, wherein said electrically-conductive protective layer has a surface electrical resistivity of less than $1\times10^{10}$ ohm per square.

10. The imaging element of claim 1, wherein said support is selected from the group consisting of cellulose esters, polyesters, polyolefins, polystyrenes, and polyacrylates.

11. The imaging element of claim 1, wherein said support is surface-treated by means of corona discharge, glow discharge, UV exposure, electron beam treatment, flame treatment, solvent washing, or adhesion-promoting agents.

12. The imaging element of claim 1, wherein the crosslinking agent comprises polyfunctional aziridines, carbodiimides or epoxies.

13. A photographic film comprising:

(1) a support having a first side and a second side;

(2) at least one silver halide emulsion layer superposed on the first side of said support; and (3) a transparent, electrically-conductive, abrasion-resistant, backing layer superposed on the second side of the support comprising conductive antimony-doped tin oxide particles dispersed in a polyurethane film-forming binder with a crosslinking agent wherein the polyurethane film-forming binder has a tensile elongation to break of at least 50% and a Young's modulus at a 2% elongation of at least 50,000 $lb/in^2$ and wherein said antimony-doped tin oxide particles are 0.01 $\mu$m or less in mean diameter and have an x-ray crystallite size of about 50 Å or less.

* * * * *